US011459769B2

(12) United States Patent
Yeo

(10) Patent No.: US 11,459,769 B2
(45) Date of Patent: Oct. 4, 2022

(54) BRICK PANEL ASSEMBLY SYSTEM

(71) Applicant: EUTOPLUS CO., LTD, Yongin-si (KR)

(72) Inventor: Yong Soo Yeo, Yongin-si (KR)

(73) Assignee: EUTOPLUS CO., LTD, Yongin-si (KR)

( * ) Notice: Subject to any disclaimer, the term of this patent is extended or adjusted under 35 U.S.C. 154(b) by 12 days.

(21) Appl. No.: 17/010,602

(22) Filed: Sep. 2, 2020

(65) Prior Publication Data

US 2022/0064960 A1 Mar. 3, 2022

(51) Int. Cl.
*E04F 13/08* (2006.01)

(52) U.S. Cl.
CPC .... *E04F 13/083* (2013.01); *E04F 2201/0517* (2013.01)

(58) Field of Classification Search
CPC . E04F 13/0819; E04F 13/0803; E04F 13/083; E04F 13/142; E04F 2201/0517
See application file for complete search history.

(56) References Cited

U.S. PATENT DOCUMENTS 2,044,216 A * 6/1936 Klages ..... E04F 13/0803 52/774
6,421,974 B1 * 7/2002 Whitehouse ..... E04F 13/0864 52/384
6,802,165 B1 * 10/2004 Passeno ..... E04F 13/0862 52/288.1
9,145,689 B2 * 9/2015 Deumer ..... E04F 13/0816
2010/0199585 A1 * 8/2010 Stevens ..... E04F 13/0803 52/475.1

FOREIGN PATENT DOCUMENTS

KR 10-1334320 11/2013
KR 1020170177800 * 1/2019

* cited by examiner

*Primary Examiner* — Babajide A Demuren
*Assistant Examiner* — Daniel J Kenny
(74) *Attorney, Agent, or Firm* — Schroeder Law PC

(57) ABSTRACT

A system for dry execution of a finishing material according to one aspect of the present invention can comprise an angled rod fixed to the outer wall of the building, a fixing bracket in which both ends are fixed and installed to the angled rod, an insulation material provided on one side of the fixing bracket to exert insulation and water blocking performance, and a brick which is provided on the other side of the fixing bracket, and in which an insertion groove is formed on one side that faces with the fixing bracket to be combined in a way to insert to the fixing bracket, wherein the fixing bracket comprises an insertion clip which is inserted to the insertion groove to allow the brick to combine with the fixing bracket, and an elastic clip which is provided on the left and right sides of the insertion clip respectively to provide elastic force that pushes in a direction of the other side of the brick with the insertion clip inserted to the insertion groove.

6 Claims, 5 Drawing Sheets

BRICK PANEL ASSEMBLY SYSTEM

TECHNICAL FIELD

The present invention relates to a system for dry execution of a finishing material, more specifically, to a system for dry execution of a finishing material that can install the finishing material such as brick, etc. without secondary fixing work.

BACKGROUND ART

In general, there is a wet method of construction and a dry method of construction as a finishing method of construction that attaches and fixes finishing materials such as pottery, ceramic, stone, or terracotta panel, brick to the inner and outer walls of the building when constructing the interior and exterior of the building.

As wet method of construction relates to executing by using cement mortar adhesive between the inner and outer walls of the building and finishing materials, it is attached to the walls one by one by applying cement, an adhesive, on the other side and adjusting joints for each finishing material. Therefore, working hour is long, labor cost is high, and curing time of cement is required.

As dry method of construction relates to attaching finishing materials separately from the inner and outer walls of the building by installing a separate fixing member consisting of metal, etc. between the inner and outer walls and finishing materials, it has the advantage that executing time is short, the work is easy, and insulation composition is easy. Therefore, the executing method of construction fixing the exterior materials such as brick has been done by using the dry method of construction recently.

However, the finishing materials such as brick can be inserted to a separate fixing member consisting of metal, etc., but, as shaking, etc. occurs with the finishing materials inserted to the fixing member, secondary fixing work is required to fix the finishing materials and the fixing member with the finishing materials inserted into the fixing member.

As such, as the secondary fixing work is required to fix an exterior material to the fixing member, there were problems that labor cost and material cost increase, executing time becomes longer.

And, there was a problem that the finish of the building was not neat if the execution were not done precisely by non-skilled person during the secondary fixing work.

In addition, there were problems of occurrence of condensation, degradation of insulation performance and water blocking performance by heat exchange phenomenon through the fixing member and cold air or moisture penetrating into connection section of the fixing member.

RELATED ART DOCUMENT

Patent Document

Similar disclosures are shown in the prior art, for example, in Korean Patent No. KR 10-1334320, published Nov. 27, 2013.

DISCLOSURE

Technical Problem

The present invention is to solve such problems, and a system for dry execution of a finishing material according to the present invention is to provide a system for dry execution of a finishing material that can install the finishing materials only with dry execution not requiring the secondary fixing work for fixing the finishing materials to a fixing member.

Also, the present invention is to provide a system for dry execution of a finishing material that can maintain constant quality of execution, though executed by non-skilled person during the secondary fixing work.

Also, the present invention is to provide a system for dry execution of a finishing material that can be easily executed, and improve insulation performance and water blocking performance.

Technical Solution

In order to achieve the above objects, a system for dry execution of a finishing material according to one embodiment of the present invention can comprise an angled rod fixed to the outer wall of the building, a fixing bracket in which both ends are fixed and installed to the angled rod, an insulation material provided on one side of the fixing bracket to exert insulation and water blocking performance, and a brick which is provided on the other side of the fixing bracket, and in which an insertion groove is formed on one side that faces with the fixing bracket to be combined in a way to insert to the fixing bracket, wherein the fixing bracket comprises an insertion clip which is inserted to the insertion groove to allow the brick to combine with the fixing bracket, and an elastic clip which is provided on the left and right sides of the insertion clip respectively to provide elastic force that pushes in a direction of the other side of the brick with the insertion clip inserted to the insertion groove.

The fixing bracket can comprise a fixing plate comprising the insertion clip and the elastic clip, and an overlapping plate extending in a direction of up and down of the fixing plate respectively, and contacting face to face in a direction of the front and the rear with another fixing bracket neighboring in a direction of up and down.

The overlapping plate comprises a front portion extending in a lower direction of the fixing plate, and a rear portion extending in an upper direction of the fixing plate, wherein the rear portion can be located in the rear of the front portion of another fixing bracket neighboring in an upper direction to hold up the front portion.

The front portion can comprise a lower extending plate extending from the bottom of the fixing plate in a direction of the insulation material, a front plate extending from one end of the lower extending plate to be provided long in a direction of ground surface, and a supporting plate extending from one end of the front plate in a direction of the brick.

The rear portion can comprise an upper extending plate extending from the top of the fixing plate in a direction of the insulation material to hold up a supporting plate of another fixing bracket neighboring in an upper direction, and a rear plate extending from one end of the upper extending plate, and provided long in a direction corresponding with ground surface to contact face to face with rear side of the front plate of another fixing bracket neighboring.

The insertion clip can comprise a supporting portion having one end fixed to the fixing plate, provided diagonally long in a direction of the brick to hold up a protruding projection of the brick, and an insertion portion extending from the supporting portion to be inserted to the insertion groove to contact face to face with one side of the protruding projection.

The elastic clip can comprise a first elastic portion having one end fixed to the fixing plate to be provided diagonally long in a direction of the brick, and a second elastic portion extending from the first elastic portion to contact face to face with the other side of the protruding projection.

A separate space, where the protruding projection is inserted in, can be formed between the insertion portion and the second elastic portion.

A joint forming member can be provided to form a vertical joint between one side brick installed in the fixing bracket and the other side brick installed neighboring with the one side brick.

The joint forming member can have lateral side of the same form as the brick, and be formed in an elastic material to maintain water tightness between the bricks.

Advantageous Effects

A system for dry execution of a finishing material according to the present invention can install the finishing material with only dry execution not requiring secondary fixing work for fixing a brick to a fixing bracket.

Also, the present invention can maintain constant quality of execution, though executed by non-skilled person during the secondary fixing work.

Also, the execution can be easy as a fixing bracket and an insulation material can be executed in integrated form, and insulation performance and water blocking performance can be improved by an insulation material and overlapping execution.

REFERENCE NUMERAL

Figure 1:
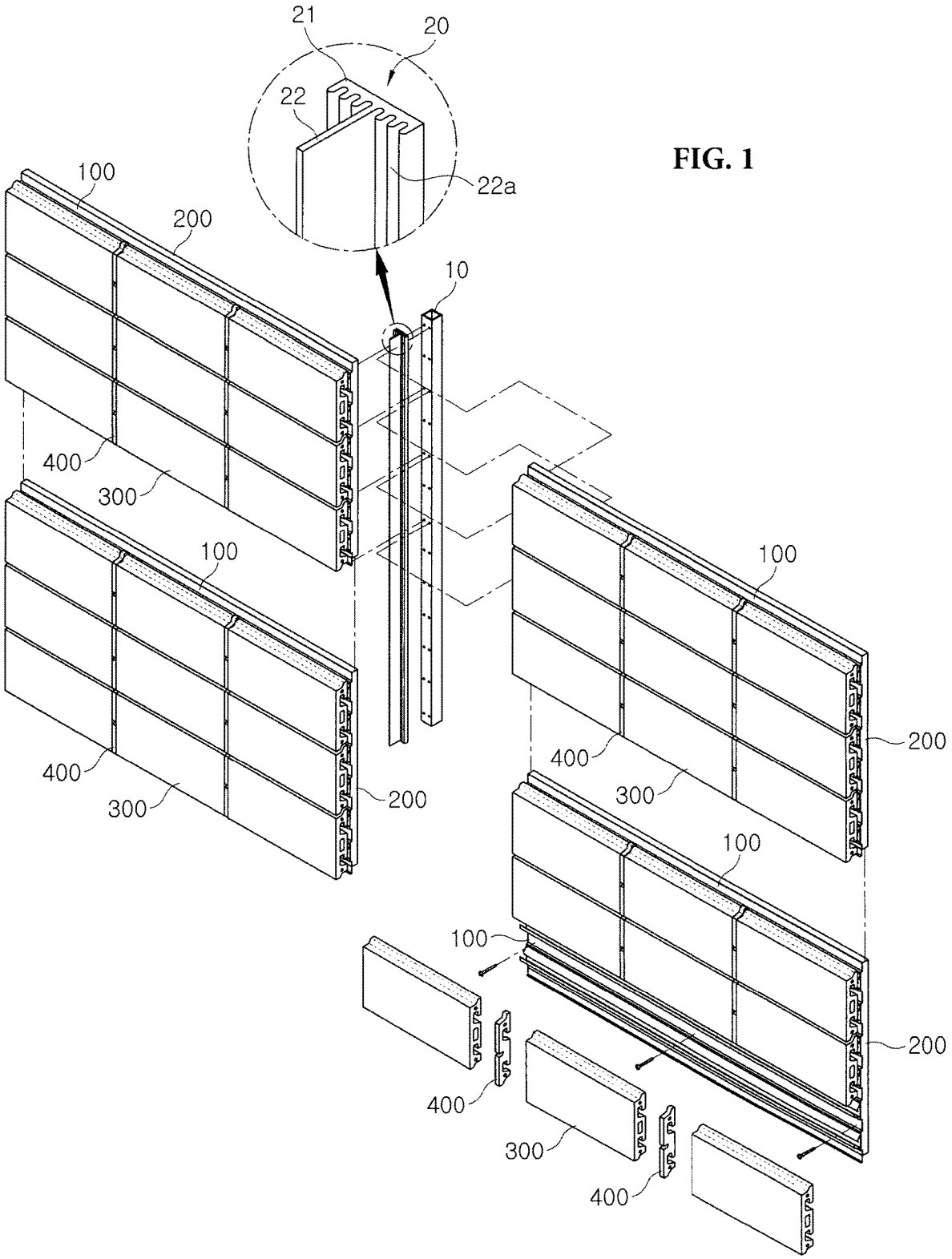
FIG. 1 is an exploded perspective diagram of a system for dry execution of a finishing material according to one embodiment of the present invention

10: an angled rod
20: a waterproof member
21: a body
22: a protrusion
22*a*: a corrugation portion
100: a fixing bracket
110: an insertion clip
111: a supporting portion
112: an insertion portion
120: an elastic clip
121: a first elastic portion
122: a second elastic portion
130: a fixing plate
140: an overlapping plate
141: a front portion
1411: a lower extending plate
1412: a front plate
1413: a supporting plate
142: a rear portion
1421: an upper extending plate
1422: a rear plate
150: a separation space
200: an insulation material
300: a brick
310: an insertion groove
320: a protruding projection
400: a joint forming member
410: a joint insertion groove
420: a joint protruding projection

DETAILED DESCRIPTION OF THE INVENTION

Hereinafter, a system for dry execution of a finishing material according to one embodiment of the present invention will be described with reference to the accompanying drawings in detail.

Figure 2:
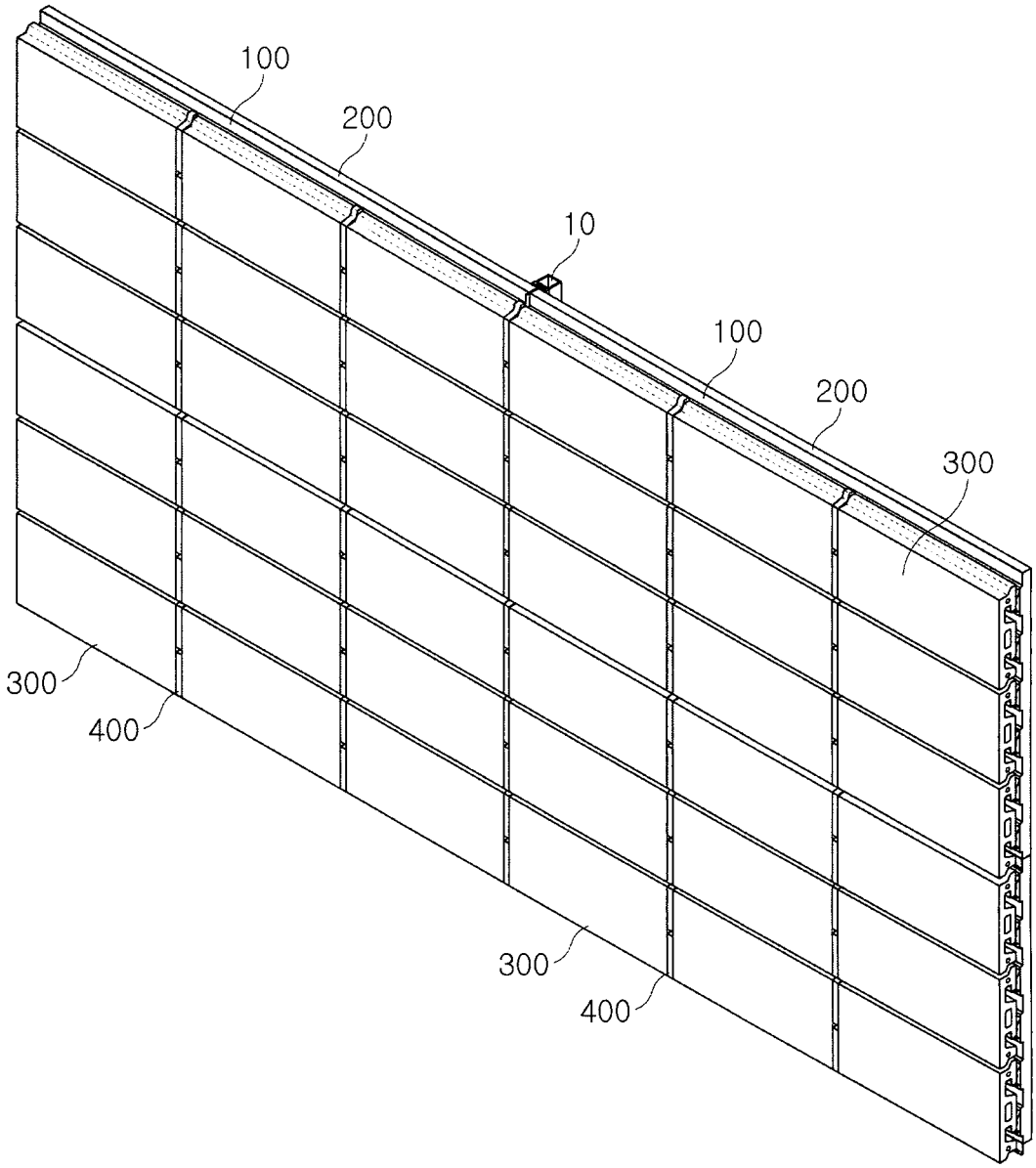
FIG. 2 is a perspective diagram of a system for dry execution of a finishing material shown in FIG. 1.

FIG. 1 is an exploded perspective diagram of a system for dry execution of a finishing material according to one embodiment of the present invention and FIG. 2 is a perspective diagram of a system for dry execution of a finishing material shown in FIG. 1.

As shown in FIG. 1 and FIG. 2, a system for dry execution of a finishing material according to one embodiment of the present invention can comprise an angled rod (10), a fixing bracket (100), an insulation material (200) and a brick (300).

An angled rod (10) is fixed on the outer wall of the building, which can be formed in the square pipe, etc. which is hollow within inner part. An angled rod (10) can tightly fix a fixing bracket (100) with formed in a material such as aluminum, stainless steel, and etc. And, when a fixing bracket (100) is fixed, one side of a fixing bracket (100) is combined with end part of the other side of a fixing bracket (100), and a waterproof member (20) can be provided to prevent moisture from penetrating between one side of a fixing bracket (100) and the other side of a fixing bracket (100). A waterproof member (20) can be formed in an elastic material to tightly contact with a fixing bracket (100) to prevent moisture from penetrating. If explaining a waterproof member (20) in detail, an angled rod (10) can comprise a protrusion (22) inserted between a body (21) and end part of one side of a fixing bracket (100) and end part of the other side of a fixing bracket (100). A body (21) can be attached to an angled rod (10) with one lateral side formed flatly, and lateral side of a body (21) can tightly contact with inner side of a fixing bracket (100) with a corrugation portion (22*a*) formed. As a corrugation portion (22*a*) can be tightly contacted with inner side of a fixing bracket (100), it is possible to prevent moisture from penetrating between end part of one side of a fixing bracket (100) and end part of the other side of a fixing bracket (100).

A fixing bracket (100) can be used to fix a brick (300) as dry method of construction, and manufactured by extruding or injecting materials such as PVC or aluminum and etc. When PVC is used as a fixing bracket (100), it can be formed through injection and when aluminum is used, it can be formed through extrusion. And, a fixing bracket (100) can easily fix and support a brick (300) by inserting a brick (300) to a fixing bracket (100) with fastened to an angled rod (10) through member such as a screw (unsigned), etc. to omit the secondary fixing work using cement mortar or adhesive. Also, a brick (300) can be combined easily to a fixing bracket (100) despite of non-skilled person.

An insulation material (200) can be provided on one side of a fixing bracket (100), i.e., one side facing with the outer wall of the building. As an insulation material (200) is provided between the building and a fixing bracket (100), the heat exchange phenomenon through a fixing bracket (100) can be minimized, thus it can have an effect on improving insulation and water blocking performance of a system for dry execution of a finishing material. And, as rapid execution is achieved by manufacturing an insulation material (200) with a fixing bracket (100) in integrated form, it is possible to improve construction ability of a system for dry execution of a finishing material.

A brick (300) can be formed in a terracotta manner. Terracotta brick is obtained by extrusion molding clay into a predetermined shape and then firing at a high temperature of about 1,000~1,450° C., and aesthetics and formability are excellent as well as the materials are abundant and homogeneous, so it is a representative inorganic finishing material that can replace a natural stone finishing material. And, at least one or more of hollow portions (unsigned) can be formed inside to reduce weight.

The following will describe a fixing bracket (100) of a system for dry execution of a finishing material according to one embodiment of the present invention in more detail. In the following description, only different parts from example described above will be described in detail and detailed description will be omitted for the same or extremely similar part.

Figure 3:
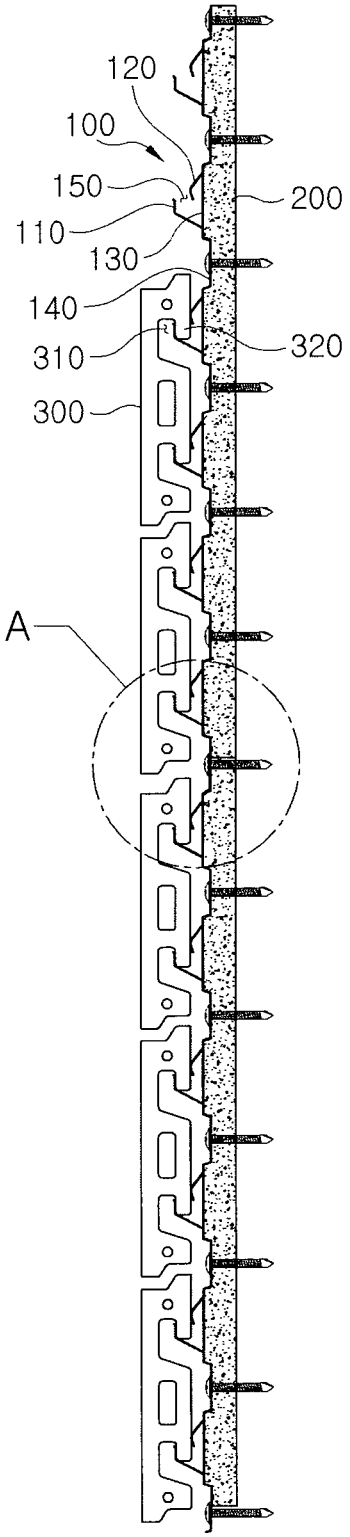
FIG. 3 is a sectional view representing a brick combining to a fixing bracket shown in FIG. 2.
Figure 4:
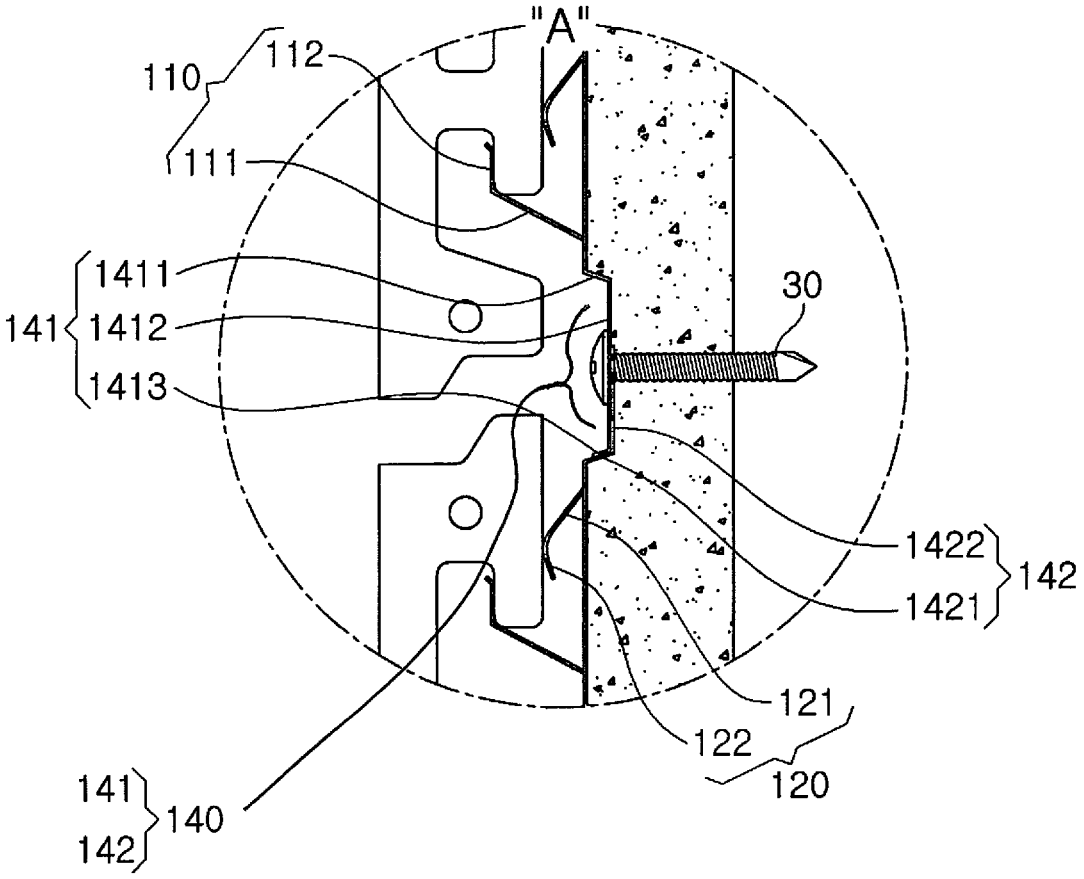
FIG. 4 is an enlarged diagram of A part shown in FIG. 3.

FIG. 3 is a sectional view representing a brick combining to a fixing bracket shown in FIG. 2, and FIG. 4 is an enlarged diagram of A part shown in FIG. 3.

With reference to FIG. 1 to FIG. 4, a fixing bracket (100) of a system for dry execution of a finishing material according to one embodiment of the present invention can comprise an insertion clip (110), an elastic clip (120), a fixing plate (130) and an overlapping plate (140).

An insertion clip (110) and an elastic clip (120) can be provided in a protruding form on one side on a fixing plate (130), i.e., one side facing with brick (300) in a direction of a brick (300). And, an overlapping plate (140) can be provided in the form of extending in a direction of up and down of a fixing plate (130) respectively to be contacted face to face with another fixing bracket (100) neighboring in a direction of up and down in overlapping form in a direction of the front and the rear.

If explaining an insertion clip (110) in detail, the insertion clip (110) can allow a brick (300) to combine with a fixing bracket (100) inserted to an insertion groove (310) formed on one side facing a fixing bracket (100) of a brick (300). To the end, an insertion clip (110) can comprise a supporting portion (111) and an insertion portion (112). A supporting portion (111) has one end fixed to a fixing plate (130), is provided diagonally long in a direction of a brick (300) and contacted face to face on the lower side of a protruding projection (320) of a brick (300) to play a role supporting a protruding projection (320). An insertion portion (112) can be extended from a supporting portion (111) and inserted to an insertion groove (310) of a brick (300). An insertion portion (112) inserted to an insertion groove (310) can be provided to contact face to face with one side of an insertion groove (310) of a protruding projection (320). As such, a supporting portion (111) and an insertion portion (112) prevent a brick (300) from leaving from a fixing bracket (100) and support the bottom, such that the brick (300) can easily remain fixed to the fixing bracket (100).

Meanwhile, an elastic clip (120) is provided on the left and right of an insertion clip (110) respectively to provide elastic force that pushes a brick (300) in a direction of other side of a brick (300), i.e., to the outside of the building with an insertion portion (112) of an insertion clip (110) inserted to an insertion groove (310) of a brick (300). To the end, an elastic clip (120) can comprise a first elastic portion (121) and a second elastic portion (122). A first elastic portion (121) can have one end fixed to a fixing plate (130) and be provided diagonally long in a direction of a brick (300). A second elastic portion (122) can be extended from the first elastic portion (121) and contact face to face with the other side of a protruding projection (320), i.e., one side facing with a fixing plate (130). Here, the elastic clip (120) can maximize elastic force by allowing a folded part contacted face to face when contacted face to face with a protruding projection (320). As such, fixing force of brick can be improved by simultaneously exerting force for pushing a brick (300) to the outside through an elastic clip (120) and force for preventing a brick (300) from being pushed to the outside.

On the other hand, separation space (150) where a protruding projection (320) of a brick (300) is inserted can be formed by allowing an insertion portion (112) of an insertion clip (110) to be provided protruding relatively longer in a direction of a brick (300) than a second elastic portion (122) of an elastic clip (120). The separation space (150) is formed same as or smaller than size of a protruding projection (320), and friction force between a protruding projection (320) and an insertion portion (112), a protruding projection (320) and a second elastic portion (122) can be increased and combining force can be improved.

Meanwhile, an overlapping plate (140) can comprise a front portion (141) extending in a lower direction of a fixing plate (130) and a rear portion (142) extending in a direction of an upper direction of a fixing plate (130). When a pair of fixing brackets (100) neighboring in a direction of up and down combine, a rear portion (142) of the fixing bracket (100) located on the bottom is provided to be located in the rear of a front portion (141) of another fixing bracket (100) located on the top and it is possible to allow a pair of fixing brackets (100) neighboring in a direction of up and down to be overlapped in part. Accordingly, air-tightness performance of the fixing bracket (100) can be improved, thus have an effect on increasing air tightness of a system for dry execution of a finishing material.

A front portion (141) can comprise a lower extending plate (1411) diagonally extended from the bottom of a fixing plate (130) in a direction of an insulation material (200), a front plate (1412) extended from one end of the lower extending plate (1411) to be provided long in a direction of ground surface, and a supporting plate (1412) extended from one end of the front plate (1412) in a direction of a brick (300).

A rear portion (142) can comprise an upper extending plate (1421) diagonally extended from the top of a fixing plate (130) in a direction of an insulation material (200) and thus holding up a supporting plate (1412) of another fixing bracket (100) neighboring in an upper direction, and a rear plate (1422) extended from one end of the upper extending plate (1421), provided diagonally long in a corresponding direction with ground surface to contact face to face with a rear side of a front plate (1412) of another fixing bracket (100) neighboring.

As an upper extending plate (1421) of a rear portion (142) is provided in form of holding up a supporting plate (1412) of a front portion (141), it can easily support a fixing bracket (100) relatively located in an upper direction, and structural stability can be increased. And, a screw (unsigned), etc. is fastened in a front plate (1412) and a rear plate (1422), and a pair of fixing brackets (100) neighboring in a direction of up and down can be integrated.

The following will describe a joint forming member (400) installed in a fixing bracket (100) of a system for dry execution of a finishing material according to one embodiment of the present invention. In the following description, only different parts from example described above will be described in detail and detailed description will be omitted for the same or extremely similar part.

Figure 5:
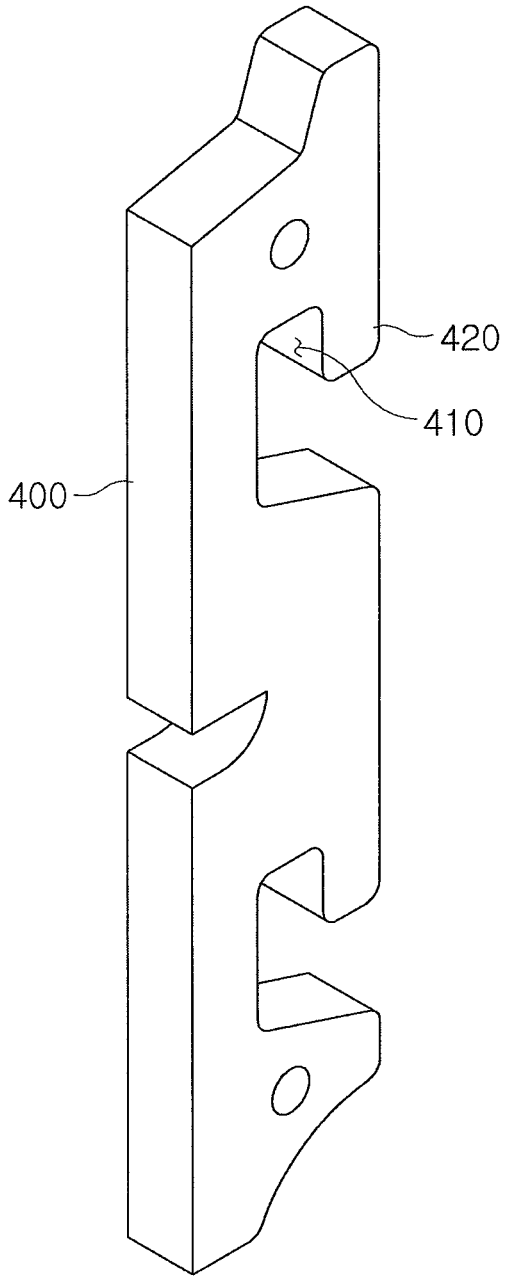
FIG. 5 is a perspective diagram representing a joint forming member shown in FIG. 1.

FIG. 5 is a perspective diagram representing a joint forming member shown in FIG. 1.

With reference to FIG. 1 to FIG. 5, a system for dry execution of a finishing material according to one embodiment of the present invention can comprise a joint forming member (400) that forms a vertical joint between one side brick (300) installed in a fixing bracket (100) and the other brick (300) installed neighboring with the one side brick.

A joint forming member (400) can have a similar lateral side form with a brick (300), and can be formed in elastic materials such as PVC or rubber material, etc. to maintain water tightness between bricks (300). And, a joint insertion groove (410) and a joint protruding projection (420) similar with an insertion groove (310) of a brick (300) and a protruding projection (320) can be provided to combine with an insertion clip (110) of a fixing bracket (100) and an elastic clip (120) in the same manner as a brick (300).

As such, as a joint forming member (400) is installed between one side brick (300) and the other brick (300) neighboring in a horizontal direction and forms a vertical joint, it can beautify the appearance and have an effect on preventing outer air, moisture, etc. from penetrating between bricks (300).

In the above, a system for dry execution of a finishing material according to one embodiment of the present invention was described, but technical spirit of the invention cannot be limited by examples disclosed herein. And, those skilled in the art that understand technical spirit of the invention can easily suggest other examples by adding, changing, deleting, appending, or etc. components within same scope of technical spirit, but it also belongs within the scope of technical spirit of the invention.

What is claimed is:

1. A system for dry execution of a finishing material, comprising:

a plurality of vertically-extending rods fixed to an outer wall of a building at predetermined distances thereacross, first and second fixing brackets each having first and second ends, the first end of each of the fixing brackets being fixed and installed to a first rod, and the second end of each of the fixing brackets being fixed and installed to a second rod, an insulation material provided an inner side of the fixing brackets to provide insulation and water blocking performance, and a first brick provided on an outer side of the fixing brackets, the first brick including an insertion groove formed on a side thereof facing the fixing brackets to attach the first brick to at least one of the fixing brackets, wherein each of the fixing brackets comprises an insertion clip which is inserted into the insertion groove to allow the first brick to attach to at least one of the fixing brackets, and an elastic clip which is provided on left and right sides of the insertion clip respectively to provide an elastic force that pushes in a direction towards the outer side of the first brick when the insertion clip is inserted into the insertion groove, each of the fixing brackets comprising:

a fixing plate including the insertion clip and the elastic clip, and a first overlapping plate extending in a vertically-upward direction with respect to the fixing plate, and a second overlapping plate extending in a vertically-downward direction with respect to the fixing plate, the first overlapping plate defining a rear portion and the second overlapping portion defining a front portion, the front portion comprising:

a lower extending plate extending from a bottom of the fixing plate in a direction towards the insulation material, a front plate extending from one end of the lower extending plate in a vertically-downward direction, and a supporting plate extending from one end of the front plate in a direction toward the brick, the rear portion comprising:

an upper extending plate extending from a top of the fixing plate in a direction toward the insulation material, and a rear plate extending from one end of the upper extending plate in a vertically-upward direction, and wherein the second fixing bracket is positioned vertically-upward from the first fixing bracket such that the front plate of the second fixing bracket is located adjacent and in contact with the rear plate of the first fixing bracket, and wherein the supporting plate of the front portion of the second fixing bracket rests upon the upper extending plate of the rear portion of the first fixing bracket, and further comprising a screw extending through the overlapping front and rear plates of the first and second fixing brackets, and extending through the insulation material, and extending into one of the rods thereby simultaneously securing the first and second fixing brackets to one another and to at least one of the rods.

2. The system for dry execution of a finishing material according to claim 1, the insertion clip comprising:

a supporting portion having one end fixed to the fixing plate and extending diagonally in a direction towards the first brick to hold up a protruding projection of the first brick, and an insertion portion extending from the supporting portion to be inserted into the insertion groove to contact one side of the protruding projection.

3. The system for dry execution of a finishing material according to claim 2, the elastic clip comprising:

a first elastic portion having one end fixed to the fixing plate and extending diagonally in a direction towards the first brick, and a second elastic portion extending from the first elastic portion to contact the other side of the protruding projection.

4. The system for dry execution of a finishing material according to claim 3, wherein a separation space is defined between the insertion portion and the second elastic portion.

5. The system for dry execution of a finishing material according to claim 1, wherein a joint forming member is provided to form a vertical joint between the first brick installed in one of the fixing brackets and an adjacent second brick.

6. The system for dry execution of a finishing material according to claim 5, wherein the first and second bricks define a cross-sectional configuration, and wherein the joint forming member has a cross-sectional configuration, and wherein the cross-sectional configuration of the joint forming member is the same as the cross-sectional configuration of the bricks, and is formed in an elastic material to maintain water tightness between the bricks.

* * * * *